US007778002B2

(12) United States Patent
Skinner et al.

(10) Patent No.: US 7,778,002 B2
(45) Date of Patent: Aug. 17, 2010

(54) METHOD AND APPARATUS TO REDUCE RING OUT IN AN IGNITION COIL TO ALLOW FOR ION SENSE PROCESSING

(75) Inventors: Albert A. Skinner, El Paso, TX (US); Mark A. Paul, El Paso, TX (US); Douglas L. Sprunger, Middletown, IN (US)

(73) Assignee: Delphi Technologies, Inc., Troy, MI (US)

( * ) Notice: Subject to any disclaimer, the term of this patent is extended or adjusted under 35 U.S.C. 154(b) by 608 days.

(21) Appl. No.: 11/747,662

(22) Filed: May 11, 2007

(65) Prior Publication Data

US 2008/0278884 A1 Nov. 13, 2008

(51) Int. Cl.
*H01H 47/00* (2006.01)
*H01H 50/10* (2006.01)

(52) U.S. Cl. ..... 361/111; 361/139; 361/142; 363/90

(58) Field of Classification Search ..... 361/111, 361/139, 142; 336/90
See application file for complete search history.

(56) References Cited

U.S. PATENT DOCUMENTS 3,007,082 A 10/1961 Kappele
3,403,666 A * 10/1968 Gerhard et al. ..... 123/621
3,594,792 A * 7/1971 Gowler et al. ..... 342/68
3,910,247 A 10/1975 Hartig
4,066,053 A * 1/1978 Noe ..... 123/604
5,051,572 A * 9/1991 Joseph et al. ..... 250/207
6,338,267 B1 1/2002 Karau
6,437,674 B1 * 8/2002 Hamer et al. ..... 336/96
6,450,157 B1 9/2002 Kesler et al.
6,615,811 B1 * 9/2003 Butler, Jr. ..... 123/606
6,666,196 B2 12/2003 Skinner et al.
6,771,521 B1 * 8/2004 Xiong et al. ..... 363/53
6,782,880 B2 8/2004 Schmied
2006/0176134 A1 8/2006 Fujiyama

OTHER PUBLICATIONS

EP Search Report dated Aug. 22, 2008.

* cited by examiner

*Primary Examiner*—Stephen W Jackson
*Assistant Examiner*—Zeev Kitov
(74) *Attorney, Agent, or Firm*—Thomas N. Twomey

(57) ABSTRACT

An ignition apparatus includes a transformer having a central core, a primary winding disposed thereabout, a secondary winding disposed outwardly of the primary winding, and an outer core or shield disposed outwardly of the secondary winding. The central and outer cores and the primary and secondary windings define a magnetic circuit through which magnetic flux flows during various phases of operation. An end-of-spark natural ringing of the secondary voltage is suppressed and limited by a control winding disposed in relation in the magnetic circuit. The control winding has a pair of terminals across which is connected a diode. The diode is oriented so that during a spark event, it is reverse biased but after the spark event it becomes forward-biased when the secondary voltage is positive so as to selectively facilitate dissipation of any residual electrical charge. Ringing is further suppressed by a resistor connected across the primary winding, or selectively connected across the primary winding using a controlled switch.

2 Claims, 5 Drawing Sheets

METHOD AND APPARATUS TO REDUCE RING OUT IN AN IGNITION COIL TO ALLOW FOR ION SENSE PROCESSING

BACKGROUND OF THE INVENTION

1. Related Field

The present invention relates generally to ignition coils, and more particularly, to a method and apparatus to reduce ring out in an ignition coil to more effectively allow for ion sense processing.

2. Description of the Related Art

Modern inductive-type automotive ignition systems commonly utilize power switching devices to control the flow of primary, charging current through the coil. Due to the inductive nature of an ignition coil, they exhibit a natural ringing of the secondary, high voltage after a spark has been extinguished ("end-of-spark ringing").

Additionally, it is known that the combustion of an air/fuel mixture in an engine results in molecules in the cylinder being ionized. It is further known to apply a relatively high voltage across, for example, the electrodes of a spark plug just after ignition to produce a current across the electrodes. Such current is known as ion current. The ion current that flows is proportional to the number of combustion ions present in the area of, for example, the spark plug gap referred to above, and is consequently indicative of the ionization throughout the entire cylinder as combustion occurs. The DC level or amount of ion current is indicative of the quantity of the combustion event, or whether in fact combustion has occurred at all (e.g., a misfire condition). An AC level of the ion current may also be used to determine whether knock exists. Systems relying on the foregoing are known as ion sense systems. In general, the end-of-spark ringing has no significant effect on ignition systems and has not caused any negative issues. However, as so-called ion sense based combustion detection systems become more prevalent, the foregoing described end-of-spark ringing can becomes an issue to deal with.

In particular, any sensing of the ion current that is done after the spark needs to timed so as to allow for the end-of-spark ringing to subside through natural decay. To account for this decay, it is known to provide an "end of last spark ring out delay" as seen by reference to U.S. Pat. No. 6,615,811 entitled "IGNITION COIL INTEGRATED ION SENSE WITH COMBUSTION AND KNOCK OUTPUTS" issued to Butler. This delay is needed to allow the secondary voltage to ring out prior to measuring ion current, for example, to detect knock.

The decay characteristics of the end-of-spark secondary voltage ring out are determined in part by the existent electrical charge as well as the inherent losses in the magnetic circuit, for example, the amount of core losses in the central magnetic core of the ignition coil ("eddy current losses"). However, as ignition coil designs improve, and the losses attributable to core losses decrease, a corresponding increase in the ring out has occurred, which remains problematic for ion sense systems.

There is therefore a need for a method and apparatus to minimize or eliminate one or more of the problems as set forth above.

SUMMARY OF THE INVENTION

The present invention provides a structure for simulating magnetic circuit losses in the ignition coil in order to limit the secondary voltage ringing at the end of discharge without causing an excessive parasitic load that would otherwise unacceptably reduce the output.

An ignition apparatus in accordance with the present invention includes a central core having a longitudinal axis, primary and secondary windings, and a shield. The core and primary and secondary windings are included in a magnetic circuit. The apparatus includes a suppression mechanism operatively coupled to the magnetic circuit configured to suppress ringing in the secondary voltage after a spark event.

In one embodiment, the suppression mechanism includes a control winding disposed in the magnetic circuit. The control winding has a pair of terminals across which a circuit element is disposed. The circuit element comprises either a diode or a shunt resistor, respectively.

In the diode embodiment, the primary winding is disposed radially-outwardly of the central core in a first winding orientation while the secondary winding is wound radially-outwardly of the primary winding and includes a high-voltage end configured for connection to a spark plug. The control winding is wound in a second winding orientation wherein the first winding orientation and the second winding orientation are the same. The diode has an anode terminal and a cathode terminal coupled to the pair of terminals of the control winding such that (i) the diode is forward-biased when a secondary voltage across the secondary winding is positive, and (ii) the diode is reverse-biased when the secondary voltage is negative.

In a still further embodiment, the shunt resistor is selectively connected across the control winding using a controlled switch.

In still further embodiments, a shunt resistor is connected across the primary winding, or, is selectively connected across the primary winding through a control circuit and an SCR.

An ignition system including an ion sense detection system is also presented.

BRIEF DESCRIPTION OF THE DRAWINGS

The present invention will now be described, by way of example, with reference to the accompanying drawings, wherein like reference numerals identify identical components in the several figures, in which.

DETAILED DESCRIPTION OF THE PREFERRED EMBODIMENTS

Figure 1:
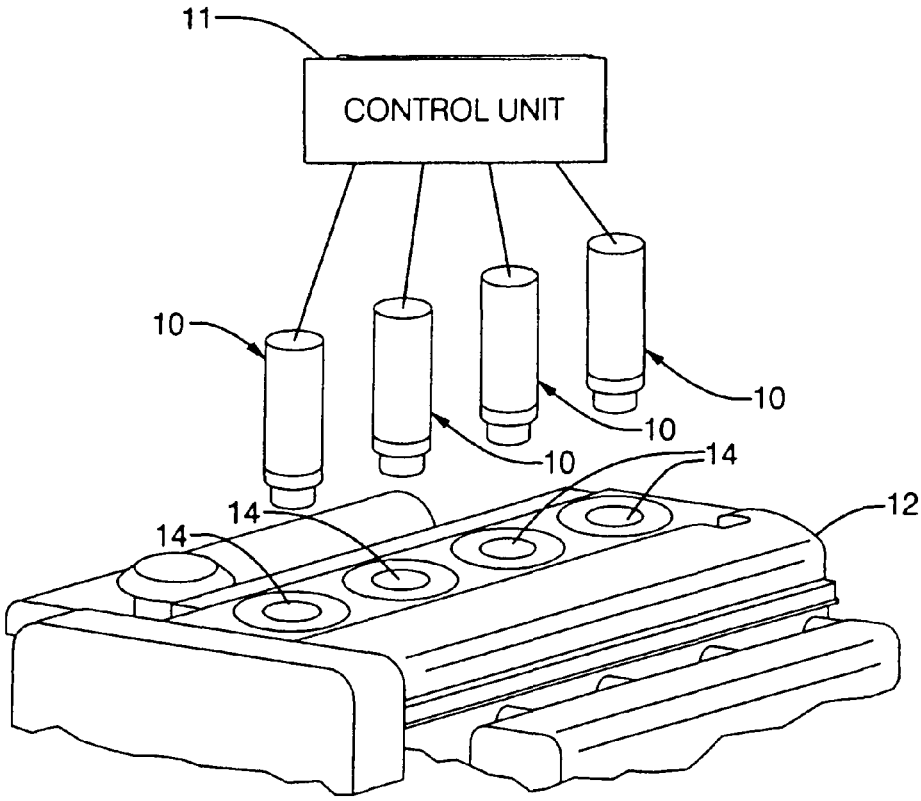
FIG. 1 is a simplified diagrammatic view of an ignition system having an ignition apparatus according to the invention.

Referring now to the drawings wherein like reference numerals are used to identify identical components in the various views, FIG. 1 shows an environment in which an ignition apparatus 10, controlled by a control unit 11 or the like, may be employed. Apparatus 10 is adapted for installation to a conventional internal combustion engine 12 by way of a spark plug 13 (best shown in FIG. 9) in threaded engagement with a spark plug opening 14 into a combustion cylinder. Generally, overall spark timing (dwell control) and the like is provided by control unit 11. In the illustrated embodiment, one ignition apparatus is provided per spark plug. Inasmuch as ignition apparatus 10 exhibits particular advantages when used in an ion sense system, either the ignition apparatus 10 or the control unit 11 (or both) include ion current sensing capability, as known in the art. For example, U.S. Pat. No. 6,615,811 entitled "IGNITION COIL INTEGRATED ION SENSE WITH COMBUSTION AND KNOCK OUTPUTS" disclose an ion sense detection system, the entire disclosure of which is hereby incorporated by reference herein.

The present invention is configured to provide a structure for simulating magnetic circuit losses (e.g., such as core losses) in ignition apparatus 10 to limit the ringing at the end of spark discharge, without causing at the same time an excessive parasitic load that would reduce the overall output of the ignition apparatus 10 (e.g., measured in energy).

Figure 2A:
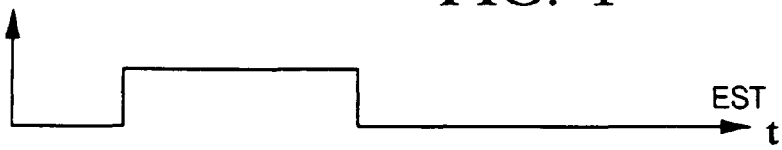
FIGS. 2A-2C are timing diagrams illustrating an electronic spark timing (EST) signal, a primary current signal, and a secondary voltage signal, respectively.
Figure 2B:
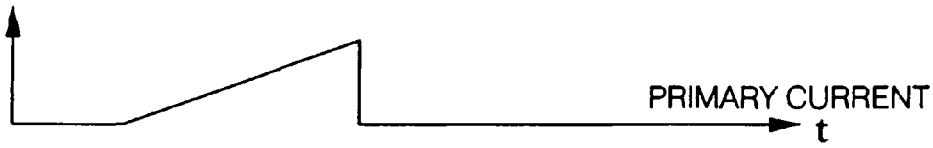
Figure 2C:
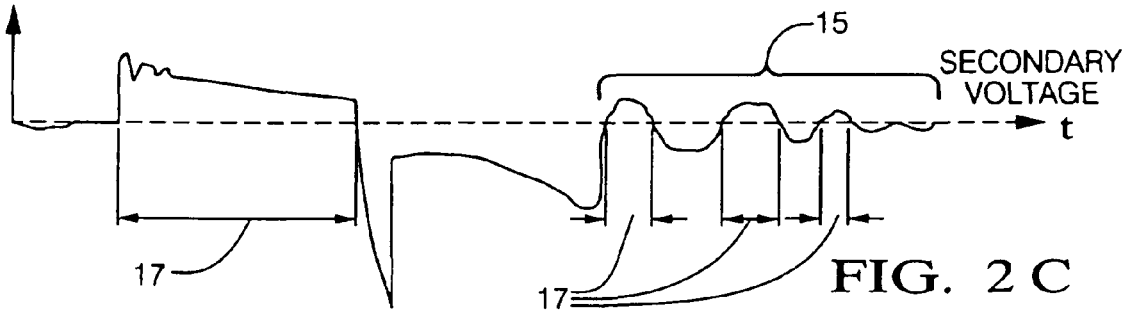

FIG. 2A shows an electronic spark timing (EST) signal as a timing reference with respect to FIGS. 2B-2C. The EST signal, as known in the art, controls the flow of primary current through the primary winding of ignition apparatus 10.

FIG. 2B shows the primary current increasing from zero in timed relation with the assertion of the EST signal. This is the well-known charging phase of the ignition apparatus.

FIG. 2C shows the secondary voltage established across the secondary winding, in timed relation to the EST signal. It should be appreciated that when the EST signal is asserted, typically, the automotive vehicle battery voltage B+ is applied across the primary winding, due to grounding one end (the low voltage end) of the primary winding via a switch closure. This battery voltage B+ also appears across the secondary winding, as shown. Immediately after the EST signal is discontinued, the switch is opened, interrupting the primary current (FIG. 2B). This results in a large, spark voltage being established across the secondary winding, as known. This is also shown in FIG. 2C as a large, negative polarity spike (not to scale). After the spark discharge event has concluded, as indicated generally when the negative polarity secondary voltage first returns to cross the zero voltage level ("zero crossing"), an interval of "ringing" thereafter typically occurs, and which is designated interval 15 in FIG. 2C.

The present invention is adapted to reduce such ringing to acceptable levels by simulating magnetic circuit losses to hasten the decay of any residual electrical charge. A number of embodiments will be disclosed, each providing an effective suppression mechanism operatively coupled to the magnetic circuit configured to suppress ringing in the output secondary voltage after a spark event.

In one embodiment (FIG. 3), a control winding and a diode are used to selectively establish such losses. The control winding and diode cooperate to bleed, effectively, residual electrical charge in order to limit the ringing. However, such diode is oriented so that it is forward-biased only during the time when the secondary current is in a direction opposite the direction of current flow that occurs during the spark event. With reference to FIG. 2C, such diode is forward-biased during the time intervals designated 17. In this manner, the arrangement will not conduct during the spark event, and thus will not affect the open circuit voltage capability of the ignition apparatus 10 or the energy delivered during the spark event. There will be, however, an incremental, parasitic loss during charging of the ignition apparatus that will increase the amount of input energy required.

Figure 3:
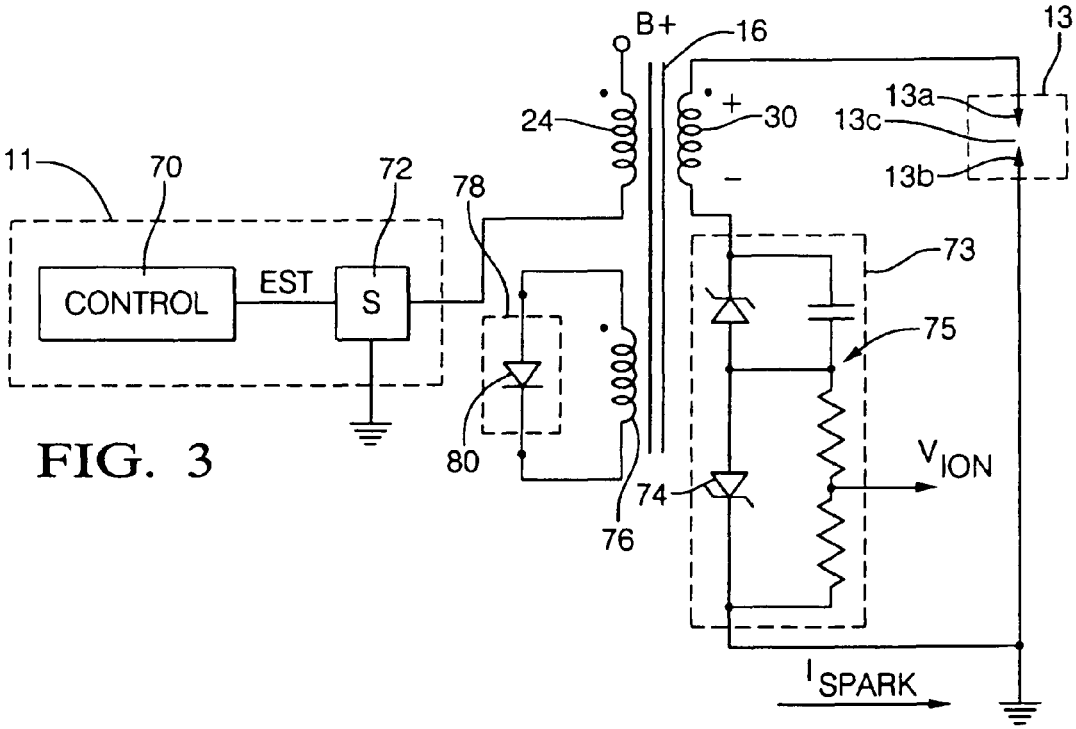
FIG. 3 is a simplified circuit diagram view of an ignition apparatus including a control winding coupled to a diode for simulating core losses without presenting an excessive parasitic load.

FIG. 3 is a simplified schematic and diagrammatic diagram of a first embodiment of the present invention, incorporating a control winding and a diode. Apparatus 10 includes a core 16, a primary winding 24, and a secondary winding 30. Additionally, apparatus 10 includes an outer magnetic core or shield 36 (best shown in FIG. 9). As appreciated in the art, a magnetic flux circuit ("magnetic circuit") is thus formed and includes at least the core 16, the primary winding 24, the secondary winding 30 and the shield 36.

With continued reference to FIG. 3, control unit 11 may itself include a control unit 70 and a switch 72. It should be understood that there are known implementations of an ignition apparatus where the primary current switch is co-located with the main ignition body and further known to dispose the switch apart from the main ignition body. Likewise, the programmed control strategies in control unit 11 may be in an independent module, in the main ignition body, or various functions thereof may be split.

Control unit 70 is configured generally to perform a plurality of functions, including generation of an ignition control signal EST (electronic spark timing). It should be understood that the ignition control signal EST may be generated or initiated by other control units not shown, such as a powertrain control module (PCM) in accordance with known ignition control strategies, and provided to control unit 70, such that control unit 70 responds by driving switch 72 to closure in response thereto. The control unit 70 may include, for example, a central processing unit (CPU), memory, and input/output, all operating according to preprogrammed strategies. The strategies enable control unit 70 to perform various functions described herein. As known, the ignition control signal defines the initial charging time (e.g., duration), and the relative timing (e.g., relative to cylinder top dead center) of when a spark is to occur. Switch 72 is configured to selectively connect primary winding 24 to ground, responsive to the ignition control signal (EST signal). Such a connection to ground, as is known generally in the art, will cause a primary current Ip to flow through primary winding 24. Switch 72 is illustrated in the Figures as a block diagram; however, it should be understood that switch 72 may comprise conventional components known to those of ordinary skill in the art, such as, for purposes of example only, an insulated gate bipolar transistor (IGBT).

With continued reference to FIG. 3, primary winding 24 is wound in a first orientation (e.g., either clockwise (CW) or counter-clockwise (CCW)), and is marked with the well-known dot convention. The secondary winding 30 is wound, as also shown by the dot convention, in an orientation such that when the positive battery voltage B+ is applied across the primary winding 24, a positive voltage will be induced across the secondary winding 30 at the dot.

The secondary circuit may also include an ion sense detection system 73 which includes a blocking diode 74 coupled to the low voltage end of secondary winding 30 and a bias and measurement circuit 75. Circuit 75 is configured to provide a bias voltage across the spark gap, while the measurement function is configured to measure the resulting ion current and produce a signal indicative thereof (designated $V_{ION}$). These functions are well understood in the art, as shown by reference to U.S. Pat. No. 6,615,811 referred to in the Background as well as U.S. Pat. No. 6,360,587 disclosing a biasing and measurement circuit. U.S. Pat. Nos. 6,615,811 and 6,360,587 are owned by the common assignee of the present invention and are herein incorporated by reference.

The high voltage end of secondary winding 30 is configured to be connected to spark plug 13. Plug 13 includes spaced electrodes 13*a*, 13*b* to define a spark gap 13*c* thereacross. It is across this gap 13*c* via electrodes 13*a*, 13*b* that an ion current is developed and measured to produce an ion current signal.

In basic operation, when the ignition control signal (EST) is discontinued, switch 72 is opened up thereby interrupting the primary current. A large voltage ("spark voltage") rise occurs across the secondary winding 30, the high voltage end of which is coupled to spark plug 13. The spark voltage is negative with respect to the polarity convention shown in FIG. 3.

The induced voltage continues to rise across this gap until breakdown occurs, resulting in an electrical discharge across the gap (i.e., the spark current, designated $I_{SPARK}$). Blocking diode 74 in the secondary circuit allows spark current to flow from ground across the spark gap 13*c*, through the secondary winding 30 and through diode 74 back to ground. However, the blocking diode 74 prevents inadvertent spark-on-make (e.g., when EST is asserted), as described elsewhere in the art. As mentioned above, at the end of the spark discharge, ordinarily, there remains some residual electrical charge that causes a natural ringing in the secondary voltage. According to the invention, however, a control structure including a control winding 76, and a circuit element 78 such as a diode 80 are configured to simulate magnetic circuit losses such as core losses without adding a parasitic load during the spark event.

Control winding 76 includes a pair of connection terminals and is wound in a second orientation, which, as shown, may be the same orientation as the primary winding 24. The control winding 76 may comprise the same type and kind of wire, namely, magnet wire, as used for the primary winding, and additionally also be wound on the central core 16 just as the primary winding 24. In one embodiment, the control winding 76 may be one (1) to five (5) turns of 20-23 AWG insulated magnet wire. The control winding 76 may be axially offset from the primary winding 24. The control winding 76 is preferably included in the magnetic circuit, as defined above, so as to be coupled with and configured to facilitate the dissipation of residual electrical charge. Diode 80 has an anode terminal and a cathode terminal that are coupled to the pair of connection terminals of control winding 76 (as illustrated) so that (1) diode 80 is forward-biased at times when a secondary voltage across secondary winding 30 is positive, and (2) diode 80 is reverse-biased at times when the secondary voltage is negative. By reference to FIG. 2C, diode 80 is forward-biased during the time intervals designated 17. Due to its orientation, as illustrated, diode 80 is reverse biased during the spark event (i.e., while a spark current $I_{SPARK}$ is carried in the secondary circuit). Although diode 80 is not in the spark current path, one may describe diode 80 as being disposed in a manner opposite that of blocking diode 74.

Figure 4:
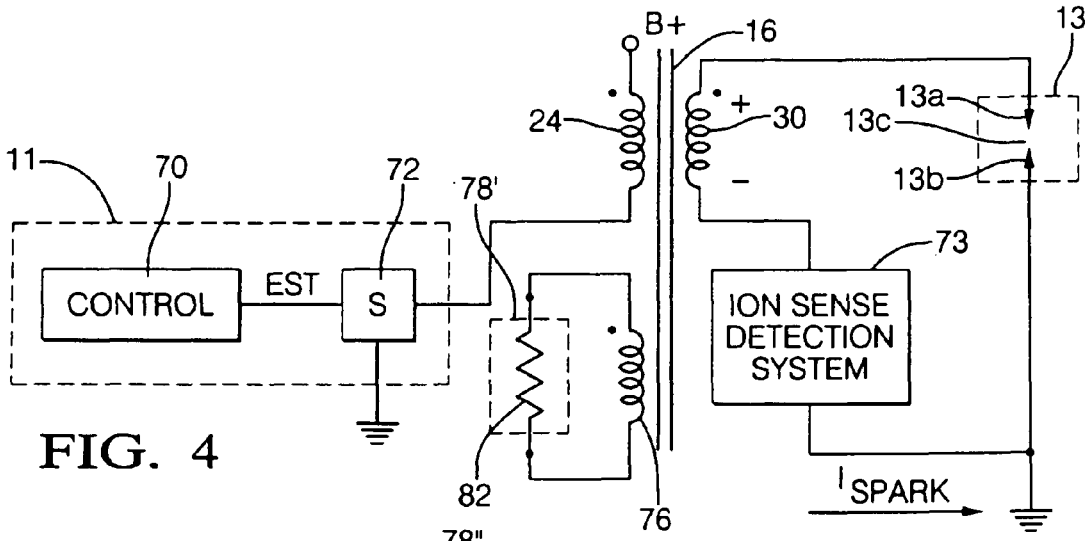
FIG. 4 is a simplified circuit diagram view of ignition apparatus including a control winding coupled to a resistor for simulating core losses without presenting an excessive parasitic load.

FIG. 4 illustrates a second embodiment of the present invention, which is the same as the embodiment of FIG. 3, except that it includes a different circuit element, designated 78', comprising a shunt resistor 82 having a preselected resistance value. The total effective load or resistance presented by the combination of the control winding 76 and the shunt resistor 82 is determined as a function of (i) the preselected resistance of resistor 82; (ii) a winding resistance of the control winding 76; and (iii) the number of turns of the primary winding and the number of turns of the control winding. This is because the resistive contribution of the winding resistance is a function of the ratio of the square of the primary turns to the square of the control winding turns. For example, for a 144 turn primary winding, a one turn control winding 76 may have a resistance ranging between about 0.004-0.009 ohms (assuming the resistance of resistor 82 is zero), and for a five turn control winding, a resistance between about 0.09 and 0.22 ohms (assuming the resistance of resistor 82 is zero). The minimum resistance (0.22 ohms) could be produced using, for example, 31 mm of 43 AWG. There are many ways to achieve the total, effective desired resistance with normal ignition wire even absent a lumped resistance via resistor 82. In one embodiment, the total, effective resistance (as defined above) may be between about 80-180 ohms. The combination of control winding 76 and shunt resistor 82 are configured to simulate magnetic circuit losses, just as with the first embodiment. While this embodiment has the same advantages of limiting undesirable end-of-spark ringing, it may nonetheless reduce the output of the ignition apparatus 10 insofar as it is not polarity sensitive and thus conducts in both directions, corresponding to both charging and discharging of the ignition apparatus.

Figure 5:
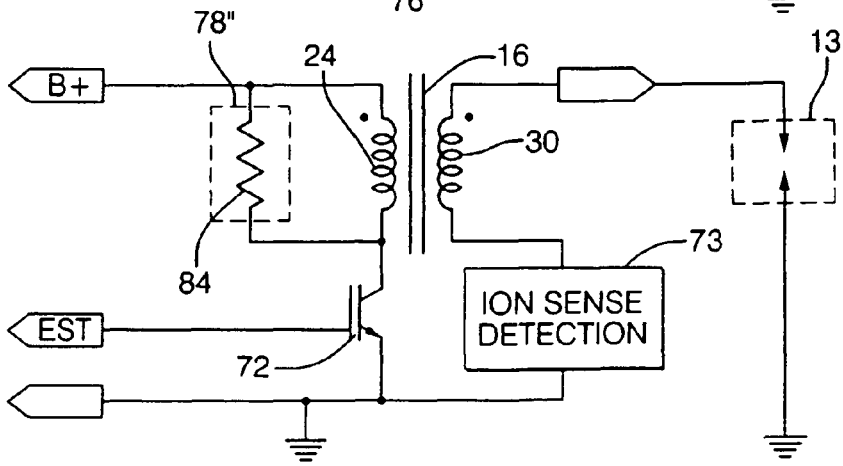
FIG. 5 is a simplified circuit diagram of a further embodiment of the present invention incorporating a shunt resistor connected across the primary winding.

FIG. 5 is a schematic diagram of a third embodiment of the present invention, except that a separate control winding is not used, but rather a shunt resistor is directly placed across the already-existing primary winding 24. In this regard, the circuit element 78" comprises a resistor 84 disposed across primary winding 24. In preferred embodiments, resistor 84 may have a resistance of between about 80-180 ohms, and more particularly about 80 ohms, when the primary control winding comprises 144 turns. This embodiment obviates the need for a separate control winding 76 and is thus lower in cost than the embodiment of FIG. 4.

Figure 6:
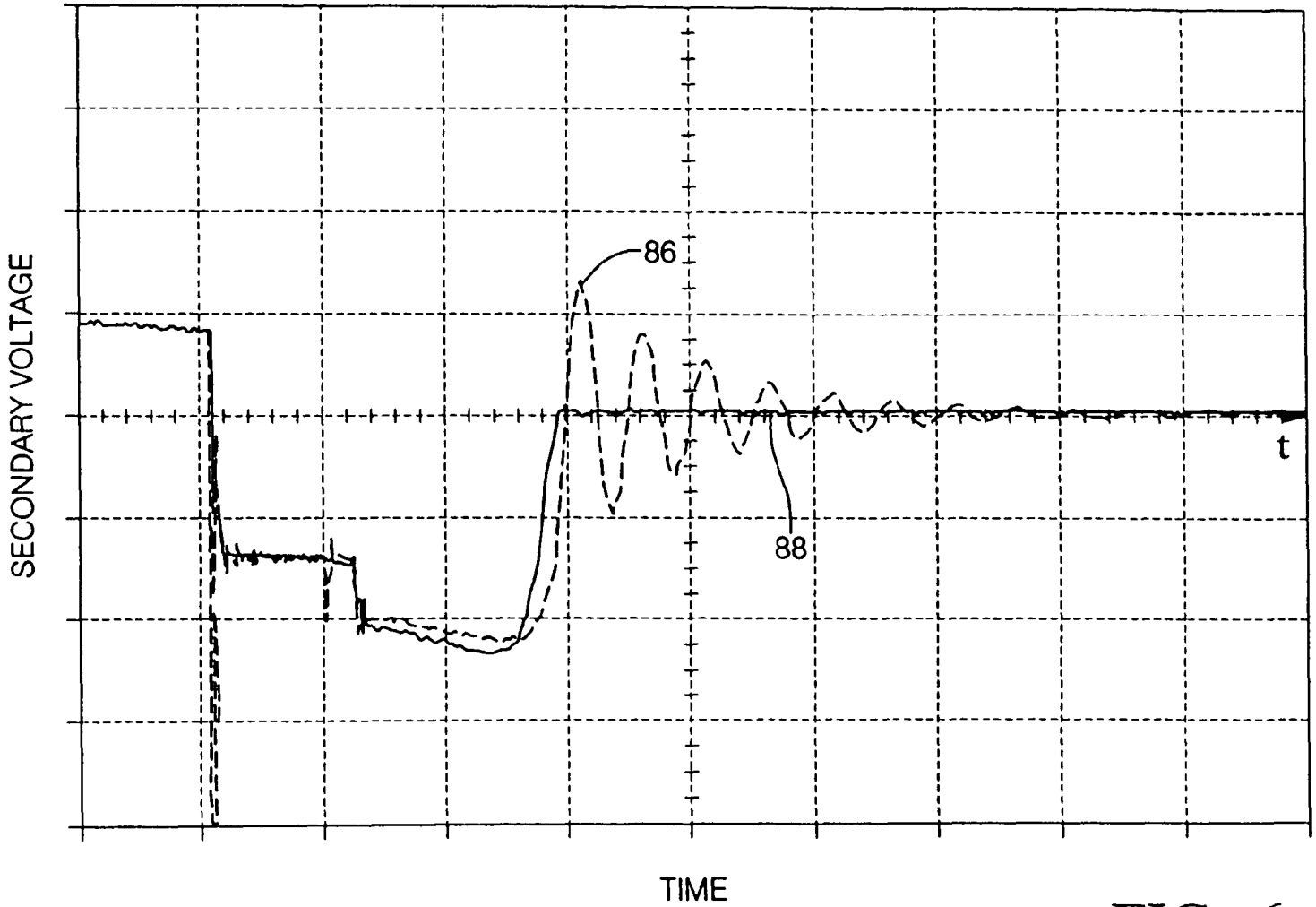
FIG. 6 is a secondary voltage versus time diagram showing the ringing suppression effect of the present invention.

FIG. 6 is a secondary voltage versus time graph that illustrates the ringing secondary voltage as trace 86, with a ringing-suppressed output according to the invention being shown as trace 88.

Figure 7:
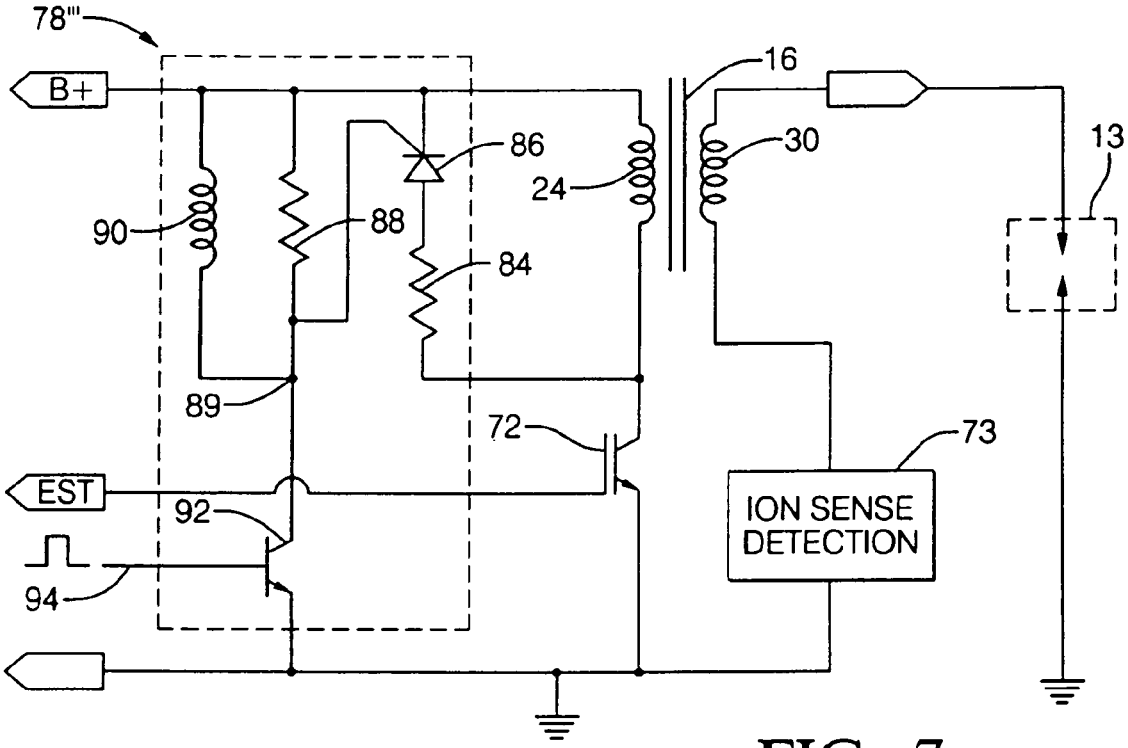
FIG. 7 is a still further embodiment incorporating an SCR to connect a shunt resistor across the primary winding.

FIG. 7 is a simplified schematic diagram of a fourth embodiment, which, like the embodiment of FIG. 5, does not include a separate control winding 76 but that which provides improved performance by switching in the shunt resistor only when needed. The embodiment of FIG. 7, however, includes additional circuitry and is thus more expensive as the trade off for improved performance.

The embodiment of FIG. 7 includes circuit element 78''' that is responsive to an input signal, designated 94, for suppressing secondary voltage ringing. Circuit element 78''' includes shunt resistor 84, a silicon-controlled rectifier (SCR) 86, pull up resistor 88, an inductor 90, and a switch such as an insulated gate bipolar transistor 92 responsive to input signal 94. The embodiment of FIG. 7 involves no change to the ignition coil (mentioned above) but does include more electronics. In effect, the resistor 88, inductor 90, and switch 92 form a control circuit for selectively causing the SCR 86 to conduct in response to a trigger signal 94 wherein the resistor 84 is shunted across the primary winding 24.

Trigger signal 94 is generated, as illustrated, as a pulse by a separate circuit (not shown) when the secondary current decreases to a predetermined level (e.g., approaches zero or in fact crosses zero) after a spark event. In one embodiment, the inductor 90 may have a value within a range of L=300 μH to L=3900 μH, preferably about L=3900 μH, while resistor 88 may have a value of approximately 25Ω. The resistor 88 is included to minimize the likelihood that a leakage spike dv/dt might turn on the SCR 86, by tying the gate and cathode terminals of the SCR 86 both to the B+ rail (i.e., same voltage). As shown, the gate terminal of SCR 86 is connected to a common node 89.

In operation, before the signal 94 is generated, the transistor 92 is OFF. The SCR 86 is also OFF since the gate terminal of the SCR 86 (via resistor 88) is at the same potential as the cathode terminal of the SCR 86. Accordingly, the shunt resistor 84 is not connected across the primary winding 24, and thus presents no load.

When the signal 94 pulses, indicating that the secondary current has decreased to near zero, the transistor 92 is placed into conduction for such time as the pulse is asserted. During such time, current flows from the B+rail through inductor 90, through transistor switch 92 to ground. This charges the inductor 90. Note, the SCR 86 is still OFF during this charging time period.

When the signal 94 transitions back to a low/zero state, transistor switch 92 turns OFF. As a consequence, the inductor current through inductor 90 continues (albeit now not through transistor switch 92), and while ultimately dissipating, the temporary voltage rise occurring on the common node 89 (a closure signal) is nonetheless effective to turn ON the SCR 86, since the common node 89 is coupled to the gate terminal of SCR 86. When SCR 86 turns on, it connects the shunt resistor 84 across the primary winding 24. It is the shunt resistor 84 that presents a load that dissipates the energy that would otherwise cause ringing (as described above). As above, shunt resistor 84 may have a value of between about 80-180 ohms.

Figure 8:
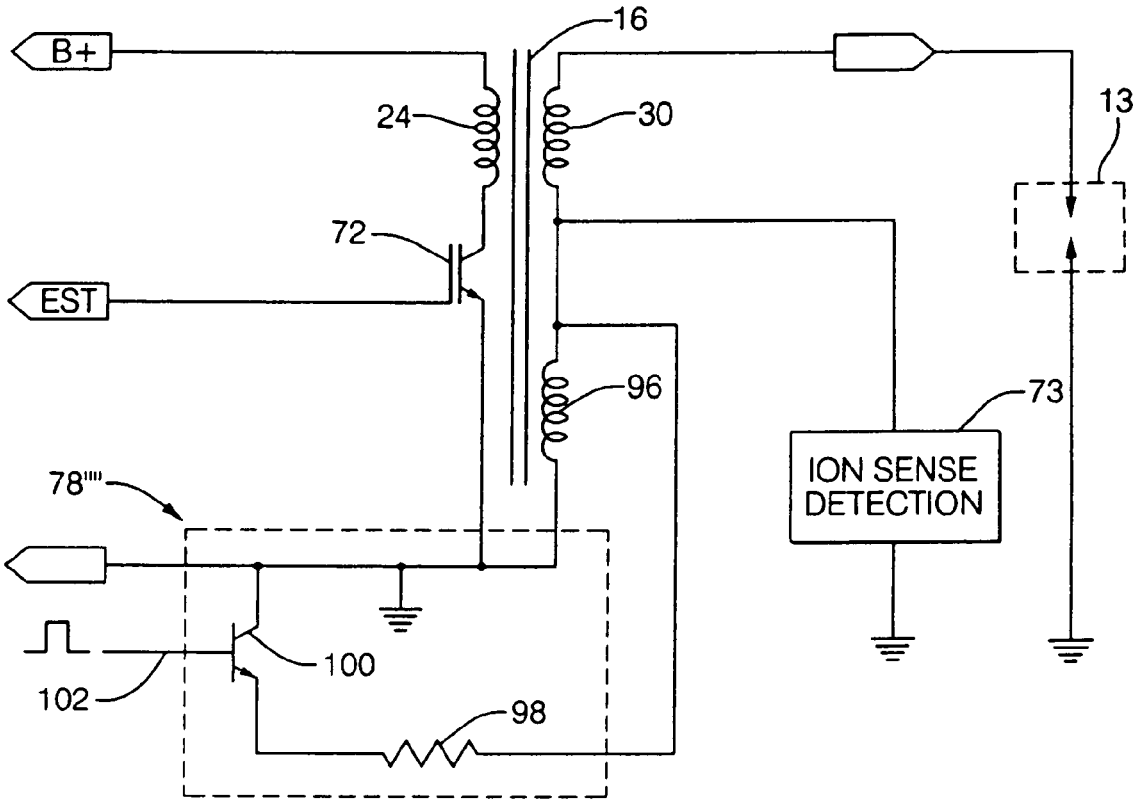
FIG. 8 is yet another embodiment incorporating a resistor selectively switched across a control winding.

FIG. 8 is a schematic diagram of a fifth embodiment of the present invention, featuring simpler electronics. In the embodiment of FIG. 8, another control winding, designated control winding 96, is employed. The control winding 96 is a tap off of the secondary winding 30, as shown. A circuit element 78"" includes a shunt resistor 98 and a switch 100. Shunt resistor 98 is shown schematically. Switch (NPN transistor) 100 is configured to selectively switch in the shunt resistor 98 that is configured to dissipate residual, existent electrical charge to suppress ringing, as described above, all in accordance with a trigger signal 102. Signal 102 may be the same as signal 94, namely, a trigger signal indicative of when the secondary current arising due to a spark event has decreased to a predetermined level (e.g., nearing zero or crossing zero). Operation is the same as for the embodiment of FIG. 4, except that the load presented by the resistor 98 is only selectively inserted in series with the control winding.

Figures 9, 9A:
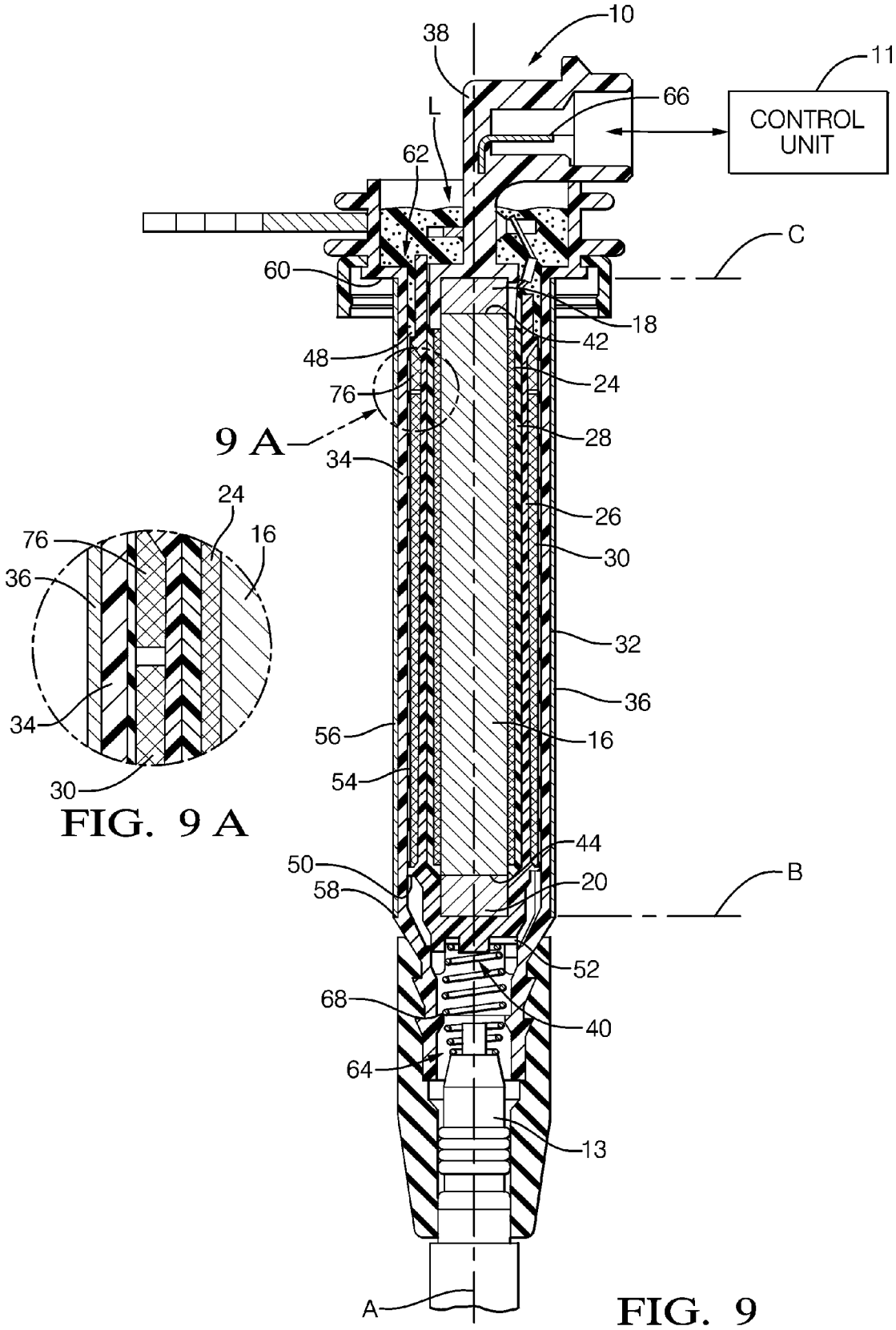
FIG. 9 is a cross-sectional view of an exemplary ignition apparatus in which the present invention may be embodied.

Referring now to FIG. 9, further details concerning an exemplary ignition apparatus 10 will now be set forth configured to enable one to practice the present invention. It should be understood that the following is exemplary only and not limiting in nature. Many other configurations are known to those of ordinary skill in the art and are consistent with the teachings of the present invention. As alluded to, the invention provides a structure in the magnetic circuit that is configured to bleed off residual electrical charge to hasten decay of the ringing in the secondary voltage after the spark event. As shown in FIG. 5, lowermost axial extent of any of the components in the magnetic circuit is illustrated by the line designated "B", which substantially corresponds to the lowermost axial edge or bottom of shield 36. As further illustrated, the uppermost axial extent of any of the components in the magnetic circuit is illustrated by the line designated "C", which substantially corresponds to the uppermost axial edge or top of shield 36. Shield 36, core 16 and magnets 18, 20 (if present) generally extend about the same axial length, and are axially co-extensive (i.e., the tops and bottoms are aligned). Thus, while magnetic flux may exist in areas below line "B" and above line "C", in the present application, magnetic circuit means at least within the axial range between lines "B" and "C".

With continued reference to FIG. 5, apparatus 10 includes core 16, optional first and second magnets 18, 20, primary winding 24, a first layer of encapsulant such as an epoxy potting material layer 26, a secondary winding spool 28, secondary winding 30, a second epoxy potting material layer 32, a case 34, shield 36, a low-voltage (LV) connector body 38, a high-voltage (HV) connector assembly 40.

Core 16 may be elongated, having a main, longitudinal axis "A" associated therewith. Core 16 includes an upper, first end 42, and a lower, second end 44. Core 16 may be a conventional core known to those of ordinary skill in the art and comprise magnetically-permeable material. As illustrated, core 16, in the preferred embodiment, takes a generally cylindrical shape (which is a generally circular shape in radial cross-section), and may comprise compression molded insulated iron particles.

Magnets 18 and 20 may be optionally included in ignition apparatus 10 as part of the magnetic circuit, and provide a magnetic bias for improved performance. The construction of magnets such as magnets 18 and 20, as well as their use and effect on performance, is well understood by those of ordinary skill in the art. It should be understood that magnets 18 and 20 are optional in ignition apparatus 10, and may be omitted, albeit with a reduced level of performance, which may be acceptable, depending on performance requirements.

Primary winding 24 may be wound directly onto core 16 in a manner known in the art. Primary winding 24 includes first and second ends and is configured to carry a primary current $I_p$ for charging apparatus 10 upon control of ignition system 11. Winding 24 may comprise magnet wire, with a thickness of between about 20-23 AWG. Winding 24 may be implemented using known approaches and conventional materials.

Layers 26 and 32 comprise an encapsulant suitable for providing electrical insulation within ignition apparatus 10. In a preferred embodiment, the encapsulant comprises epoxy potting material. The epoxy potting material introduced in layers 26, and 32 may be introduced into annular potting channels defined (i) between primary winding 24 and secondary winding spool 28, and, (ii) between secondary winding 30 and case 34. The potting channels are filled with potting material, in the illustrated embodiment, up to approximately the level designated "L". In one embodiment, layer 26 may be between about 0.1 mm and 1.0 mm thick. Of course, a variety of other thicknesses are possible depending on flow characteristics and insulating characteristics of the encapsulant. The potting material also provides protection from environmental factors which may be encountered during the service life of ignition apparatus 10. There is a number of suitable epoxy potting materials well known to those of ordinary skill in the art.

Secondary winding spool 28 is configured to receive and retain secondary winding 30. Spool 28 is disposed adjacent to and radially outwardly of the central components comprising core 16, primary winding 24, and epoxy potting layer 26, and, preferably, is in coaxial relationship therewith. Spool 28 may comprise any one of a number of conventional spool configurations known to those of ordinary skill in the art. In the illustrated embodiment, spool 28 is configured to receive one continuous secondary winding (e.g., progressive winding), as is known. However, it should be understood that other configurations may be employed, such as, for example only, a configuration adapted for use with a segmented winding strategy (e.g., a spool of the type having a plurality of axially spaced ribs forming a plurality of channels therebetween for accepting windings), as known.

The depth of the secondary winding in the illustrated embodiment may decrease from the top of spool 28 (i.e., near the upper end 42 of core 16), to the other end of spool 28 (i.e., near the lower end 44) by way of a progressive gradual flare of the spool body. The result of the flare or taper is to increase the radial distance (i.e., taken with respect to axis "A") between primary winding 24 and secondary winding 30, progressively, from the top to the bottom. As is known in the art, the voltage gradient in the axial direction, which increases toward the spark plug end (i.e., high voltage end) of the secondary winding, may require increased dielectric insulation between the secondary and primary windings, and, may be provided for by way of the progressively increased separation between the secondary and primary windings.

Spool 28 is formed generally of electrical insulating material having properties suitable for use in a relatively high temperature environment. For example, spool 28 may comprise plastic material such as PPO/PS (e.g., NORYL available from General Electric) or polybutylene terephthalate (PBT) thermoplastic polyester. It should be understood that there are a variety of alternative materials that may be used for spool 28 known to those of ordinary skill in the ignition art, the foregoing being exemplary only and not limiting in nature.

Spool 28 may further include a first annular feature 48 and a second annular feature 50 formed at axially opposite ends thereof. Features 48 and 50 may be configured so as to engage an inner surface of case 34 to locate, align, and center the spool 28 in the cavity of case 34.

In addition, the body portion of spool 28 tapers on a lower end thereof to a reduced diameter, generally cylindrical outer surface sized to provide an interference fit with respect to a corresponding through-aperture at the lower end of case 34. In addition, the spool body includes a blind bore or well at the spark plug end configured in size and shape to accommodate the size and shape of HV connector assembly 40. In connection with this function, spool 28 includes an electrically conductive (i.e., metal) high-voltage (HV) terminal 52 disposed therein configured to connect the HV end of secondary winding 30 to the HV connector assembly 40.

FIG. 5 also shows secondary winding 30 in cross-section. Secondary winding 30, as described above, is wound on spool 28, and includes a low voltage end and a high voltage end. The low voltage end may be connected to ground by way of a ground connection through LV connector body 38 in a manner known to those of ordinary skill in the art. The high voltage end is connected to HV terminal 52 in a manner described above. Winding 30 may be implemented using conventional approaches and material known to those of ordinary skill in the art.

Case 34 includes an inner, generally cylindrical surface 54, an outer surface 56, a first annular shoulder 58, a flange 60, an upper through-bore 62, and a lower through bore 64.

Inner surface 54 is configured in size to receive and retain the core 16/primary winding 24/spool 28/secondary winding 30 assembly. The inner surface 54 of case 34 may be slightly spaced from spool 28, particularly the annular spacing features 48, 50 thereof (as shown), or may engage the spacing features 48, 50.

Annular shoulder 58 and flange 60 are located near the lower, and upper ends of case 34, respectively. Shoulder 58 is formed in size and shape to engage and support a bottommost circumferential edge of shield 36. Likewise, flange 60 is configured in size and shape to engage and support an uppermost circumferential edge of shield 36.

Bore 62 is configured in size and shape to receive the combined assembly of core 16/primary winding 24/spool 28/secondary winding 30.

Bore 64 is defined by an inner surface thereof configured in size and shape (i.e., generally cylindrical) to provide an interference fit with an outer surface of spool body 28 (i.e., a lowermost portion thereof), as described above. When the lowermost body portion of spool 28 is inserted in bore 64, therefore, a seal is made.

Case 34 is formed of electrical insulating material, and may comprise conventional materials known to those of ordinary skill in the art (e.g., the PBT thermoplastic polyester material referred to above).

Shield 36 is generally annular in shape and is disposed radially outwardly of case 34, and, preferably, engages outer surface 56 of case 34. The shield 36 is preferably comprises magnetically-permeable material that is also electrically conductive material, and, more preferably metal, such as silicon steel or other adequate magnetic material. Shield 36 provides not only a protective barrier for ignition apparatus 10 generally, but, further, provides a magnetic path for the magnetic circuit portion of ignition apparatus 10. Shield 36 may nominally be about 0.50 mm thick, in one embodiment. Shield 36 may be grounded by way of an internal grounding strap, finger or the like (not shown) well know to those of ordinary skill in the art. Shield 36 may comprise multiple, individual sheets 36.

Low voltage connector body 38 is configured to, among other things, electrically connect the first and second ends of primary winding 24 to an energization source, such as, the energization circuitry included in ignition system 11. Connector body 38 is generally formed of electrical insulating material, but also includes a plurality of electrically conductive output terminals 66 (e.g., pins for ground, primary winding leads, etc.). Terminals 66 are coupled electrically, internally through connector body 38, in a manner known to those of ordinary skill in the art, and are thereafter connected to various parts of apparatus 10, also in a manner generally know to those of ordinary skill in the art.

HV connector assembly 40 may include a spring contact 68 or the like, which is electrically coupled to HV terminal 52 disposed in a blind bore portion formed in a lowermost end of spool 28. Contact spring 68 is configured to engage a high-voltage connector terminal of spark plug 13. This arrangement for coupling the high voltage developed by secondary winding 30 to plug 13 is exemplary only; a number of alternative connector arrangements, particularly spring-biased arrangements, are known in the art.

It is to be understood that the above description is merely exemplary rather than limiting in nature, the invention being limited only by the appended claims. Various modifications and changes may be made thereto by one of ordinary skill in the art, which embody the principles of the invention and fall within the spirit and scope thereof.

The invention claimed is:

1. An ignition apparatus comprising:

a central core having a longitudinal axis, said core comprising magnetically-permeable material;

primary and secondary windings outwardly of said core;

a shield outwardly of said primary and secondary windings, said shield comprising magnetically-permeable material wherein said core, said primary and secondary windings and said shield are included in a magnetic circuit, said secondary winding having a high-voltage end configured for connection to a spark plug on which a secondary voltage is produced; and a suppression mechanism operatively coupled to said magnetic circuit configured to suppress ringing in said secondary voltage after a spark event, wherein said suppression mechanism includes a shunt resistor configured to be selectively connected across said primary winding, wherein said suppression mechanism includes a series combination of a silicon controlled rectifier (SCR) and said resistor connected across said primary winding, said SCR having a gate terminal coupled to a common node of a control circuit for selectively causing said SCR to conduct wherein said resistor is shunted across said primary winding, said control circuit including a transistor switch configured to close in response to a trigger signal indicative of when a secondary current arising from a spark event has decreased to a predetermined level, said switch being coupled between said common node and ground, said control circuit further including a parallel combination of an inductor and a pull up resistor connected to said common node, wherein when said switch is closed by said trigger signal, a charging current flows through said inductor, wherein when said switch is reopened, said inductor produces a closure signal on said common node coupled to said gate terminal of said SCR, thereby causing said SCR to conduct and connect said shunt resistor across said primary winding.

2. An ignition system comprising:

an ignition apparatus having an output configured for connection to a spark plug having a spark gap thereof proximate a combustion chamber of an internal combustion engine, said apparatus being responsive to an electronic spark timing signal to generate a spark voltage on said output so as to produce a spark across said spark gap for initiating combustion in said combustion chamber; and an ion sense detection system configured for connection to said spark plug to generate a bias voltage for measuring an ion current using said spark plug, said measured ion current corresponding to a level of combustion in said combustion chamber, wherein said ignition apparatus further includes:

a central core having a longitudinal axis, said core comprising magnetically-permeable material;

primary and secondary windings outwardly of said core;

a shield outwardly of said primary and secondary windings, said shield comprising magnetically-permeable material wherein said core, said primary and secondary windings and said shield are included in a magnetic circuit; and a suppression mechanism operatively coupled to said magnetic circuit configured to suppress ringing in said secondary voltage after a spark event, wherein said suppression mechanism includes a shunt resistor configured to be selectively connected across said primary winding, wherein said suppression mechanism includes a series combination of a silicon controlled rectifier (SCR) and said resistor connected across said primary winding, said SCR having a gate terminal coupled to a common node of a control circuit for selectively causing said SCR to conduct wherein said resistor is shunted across said primary winding, said control circuit including a transistor switch configured to close in response to a trigger signal indicative of when a secondary current arising from a spark event has decreased to a predetermined level, said switch being coupled between said common node and ground, said control circuit further including a parallel combination of an inductor and a pull up resistor connected to said common node, wherein when said switch is closed by said trigger signal, a charging current flows through said inductor, wherein when said switch is reopened, said inductor produces a closure signal on said common node coupled to said gate terminal of said SCR, thereby causing said SCR to conduct and connect said shunt resistor across said primary winding.

* * * * *